United States Patent [19]

Stanton

[11] Patent Number: 4,461,187

[45] Date of Patent: Jul. 24, 1984

[54] PUMP JACK

[75] Inventor: George E. Stanton, Orient, Ohio

[73] Assignee: NuJack Corporation, Columbus, Ohio

[21] Appl. No.: 317,700

[22] Filed: Nov. 2, 1981

[51] Int. Cl.[3] ..... F16H 21/32; F16H 19/06

[52] U.S. Cl. ..... 74/41; 74/37

[58] Field of Search ..... 74/41, 37, 589, 591

[56] References Cited

U.S. PATENT DOCUMENTS

| | | | |
|---|---|---|---|
| 1,592,391 | 7/1926 | Stevenson | 74/589 |
| 1,699,675 | 1/1929 | Reschke | 74/41 |
| 1,758,730 | 5/1930 | Winters | 74/45 |
| 2,488,124 | 11/1949 | Hawley et al. | 74/41 |
| 2,526,561 | 10/1950 | Keltner | 74/37 |
| 3,018,865 | 1/1962 | Blackburn | 74/589 |
| 3,310,988 | 3/1967 | Gault | 74/41 |
| 4,121,475 | 10/1978 | McIlwain | 474/135 |

*Primary Examiner*—Lawrence J. Staab
*Assistant Examiner*—Michael J. Gonet
*Attorney, Agent, or Firm*—Millard & Cox

[57] ABSTRACT

A pump jack comprises a rocker arm one end of which is fixed to the upper end of a sucker rod. The other limb of the rocker arm has rigidly affixed thereto a downwardly-extending drive support member and a large driven pinion is eccentrically and rotatably mounted at the lower end of this drive support member. The driven pinion is engaged by a chain, which also passes around a driving pinion fixed to the base of the pump jack. This drive arrangement reduces the acceleration and shock loadings imposed upon the sucker rod at the beginning of its upstroke and reduces the size and cost of the gearbox necessary to connect a prime mover to the driving pinion.

13 Claims, 8 Drawing Figures

PUMP JACK

BACKGROUND OF THE INVENTION

The invention relates to a pump jack for pumping liquids, especially oil from wells.

One conventional type of pump jack for pumping oil, water or other liquids from a well comprises a rocker arm pivotally mounted intermediate its ends on a support member. On one limb (hereinafter referred to as the sucker-rod limb) of this rocker arm are fixed sucker rod attachment means which are connected to a sucker rod which descends into the well and is connected to the piston of a reciprocatory pump mounted within the well, at the bottom or at some other level from which the liquid is to be pumped. Usually, a counterweight is mounted upon the opposed limb of the rocker arm (hereinafter referred to as the "drive limb") to counterbalance the greater weight of the sucker rod and piston. To pivot the rocker arm, and thus to reciprocate the sucker rod vertically within the well, the upper end of a crank is fixed to the drive limb of the rocker arm. The lower end of this crank is connected to a rotating arm fixedly mounted on a rotating drive shaft positioned below the drive limb of the rocker arm. The drive shaft is rotated by a gearbox from any conventional type of motor, this motor usually either being an electric motor or an internal combustion engine. The rotation of the drive shaft causes the sucker rod to reciprocate vertically; the motion of the sucker rod is substantially simple harmonic motion, subject only to minor, second-order deviations due to the displacement of the crank from the vertical during the rotation of the drive shaft. Thus, approximately half-way through its upstroke, the sucker rod is traveling at its maximum velocity and from this point there is applied to the sucker rod a progressively increasing downward acceleration until the sucker rod finally halts at the end of its upstroke. This same downward acceleration is continued into the first part of the downstroke, but decreases progressively until, approximately half-way through the downstroke, no acceleration is being applied, although the sucker rod is moving downwardly at its maximum velocity. For the remaining half of the downstroke, there is applied to the sucker rod a steadily increasing upward acceleration until the sucker rod reaches the end of its downstroke, whereupon this upward acceleration is continued but at a steadily decreasing rate until the upward acceleration ceases approximately half way through the next upstroke. The maximum accelerations imposed upon the sucker rod are considerable; for example, in a typical conventional pump jack having a stroke of three feet (0.91 m) and a five-second pumping cycle (a pumping cycle comprising one upstroke and one downstroke), the maximum acceleration upon the sucker rod is approximately 2.4 feet per second$^2$ (0.73 m.sec.$^{-2}$).

The loads imposed upon the sucker rod of an oil well pump jack are considerable. During the upstroke in a typical oil well, the weight of the sucker rod and the oil being lifted therewith amounts to about 1.6 pounds per foot (2.38 kg/m) of well depth and thus about eight thousand pounds (3629 kg) in a 5,000 ft. (1524 m.) well and many oils wells are considerably deeper. When a conventional rocker arm oil well pump jack is in use, it is obvious to even the casual observer that very large shock loadings are being placed upon the sucker rod as the sucker rod reverses its motion at the end of the upward and downward stroke; often the frame supporting the rocker arm can be seen to flex and vibrate, especially as the sucker rod begins its upward stroke. I have concluded that these large shock loadings upon the sucker rod arise because there is a large difference between the upwardly directed force which is needed to stop the downward stroke of the sucker rod and that necessary to cause the sucker rod to begin its upward stroke. During its downward stroke, the sucker rod and the piston connected thereto do not have to support the weight of the column of oil within the well (obviously, the well is provided with means to prevent the column of oil flowing back down the well as the sucker rod and piston descend). Thus, to stop the downward stroke of the sucker rod, the pump jack need only impose on the sucker rod an upwardly directed force about equal to the weight of the sucker rod and piston less the weight of any counterweights used. However, during the upward stroke of the sucker rod, not only must the sucker rod and piston be lifted, but also the column of oil within the well, thus, at the beginning of the upward stroke of the sucker rod the pump jack must impose upon the sucker rod an upwardly directed force at least about equal to the weight of the sucker rod, piston and the column of oil in the well, again less the counterweights employed. The column of oil in a typical 5,000 ft. (1524 m.) well weighs about 3,000 pounds (1361 kg.) and thus at the beginning of each upward stroke this weight is instantaneously imposed upon the sucker rod, resulting in a massive shock loading thereon. This shock loading is made worse by the fact that, since a conventional pump jack sucker rod undergoes substantially simple harmonic motion, the acceleration is at a maximum at the extremities of the motion where the shock loading occurs. These repeated shock loadings upon the sucker rod tend eventually to cause fractures thereof, leaving a considerable length of broken sucker rod in the well. To retrieve the broken sucker rod, a crew must be employed to fish the broken rod out through the surrounding casing, a procedure which involves considerable expense and a lengthy interruption of production from the well, since pumping of oil therefrom cannot be resumed until the broken sucker rod has been removed and replaced with a new one.

Also, a considerable proportion of the cost of a conventional oil well pump is accounted for by the gearbox necessary to reduce the speed of rotation of the prime mover driving the pump jack to the speed of rotation to the drive shaft bearing the rotating arm. Largely because of the considerable shocks imposed upon the whole apparatus by the sucker rod, such gearboxes must be made very robust and are correspondingly expensive to produce.

It will be appreciated that the problems mentioned above are not confined to oil wells, but may be experienced in other wells, such as water wells, which pump liquid to the surface in substantially the same manner as an oil well.

Numerous proposals have been made for reducing the shocks experienced by sucker rods at the end of their strokes, and some of these proposals also reduce the cost and complexity of the gearbox required in the pump jack. For example, U.S. Pat. No. 1,592,391 issued July 13, 1926 to Stevenson proposes a pump jack in which, as in a conventional pump jack, a crank is pivotally mounted at its upper end on the drive limb of a rocker arm. However, in Stevenson's pump the lower end of the rocker arm is rotatably and eccentrically mounted on a driven sprocket. This driven sprocket engages a chain, which also passes around a smaller driving sprocket mounted upon the base of the pump jack and is driven by any convenient type of prime mover. Although Stevenson's pump may reduce the cost of the necessary gearbox, since the final reduction in drive speed is accomplished by the gearing between the small driving sprocket and the large driven sprocket, calculations presented below show that it has only a smal effect in reducing the acceleration at the beginning of the upstroke of the pump and thus little effect in reducing the shock loading on the sucker rod at the beginning of the upstroke.

A further prior art proposal, set forth in U.S. Pat. No. 2,488,124 issued Nov. 15, 1949 to Hawley, again involves the use of a small driving sprocket mounted on the base of a pump jack, and a chain engaging this driving sprocket and a much larger driven sprocket. In Hawley's pump, however, the large driven sprocket is eccentrically mounted directly on the rocker arm, the rocker arm being in the form of a split beams so that the driven sprocket can be accomodated between the two parts of the sucker rod. Hawley's pump does reduce the complexity of the gearbox required to drive the pump jack and, as will be shown by calculations below, does help to reduce the acceleration imposed upon the sucker rod at the beginning of the upstroke and thus the shock loading imposed upon the sucker rod.

I have now devised a pump jack which, like the Stevenson and Hawley pump jacks described above, makes use of an eccentrically mounted circular driven member. However, my pump jack has certain features not found in these prior art proposals and calculation shows that it is more successful than either the Hawley or Stevenson proposals in reducing the acceleration imposed upon the sucker rod at the beginning of the upstroke, and thus in reducing the shock loading upon the sucker rod.

SUMMARY OF THE INVENTION

The instant pump jack comprises a support member and a rocker arm pivotally mounted intermediate its ends on the support member. Sucker rod attachment means, which preferably have a form of a conventional horsehead, are disposed adjacent the end of the sucker-rod limb of the rocker arm in order that a sucker rod may be attached to the rocker arm. The instant pump jack further comprises a drive support member non-rotatably mounted on the rocker arm and having a lower end disposed beneath the drive limb of the rocker arm, a circular driven member rotatably and eccentrically mounted on the drive support member adjacent the lower end thereof, a circular driving member mounted for rotation about its axis, this axis being fixed relative to the support member, drive means for driving the rotating member about its axis, and a flexible belt member engaging the driving and driven members such that rotation of the driving member will cause the driven member to rotate about the point at which the driven member is mounted on the drive support member.

In saying that the driven member is mounted on the drive support member adjacent the lower end thereof, I mean that the mounting point of the driven member may be either at the extreme end of the drive support member or a short distance therefrom, and the phrase "adjacent to" herein is to be construed accordingly.

In my pump, the driving and driven members preferably comprise sprockets and the flexible belt member preferably comprises a chain. Desirably a chain tensioner is provided to maintain tension in the chain.

It will be appreciated that, for my pump jack to function properly, it is essential that the flexible belt member be kept under tension at all times. As with conventional pump jacks, counterweights may be provided on the drive limb of the rocker arm of my pump jack in order to reduce the force necessary to lift the sucker rod during the upward pumping stroke, but in considering the weight and position of the counterweights to be employed care should be taken to ensure that a sufficient residual downward force exists on the sucker rod at all times so that the flexible belt member is constantly under tension.

In order to facilitate installation of my pump jack on an oil or other well and to facilitate the adjustment of the counterweighting of the pump jack, I prefer to provide my pump jack with a number of adjustments. As already stated, the preferred sucker rod attachment means is a horsehead pivotally mounted on the rocker arm and I prefer to provide horsehead adjustment means for pivoting the horsehead relative to the rocker arm and holding the horsehead at varying angles relative thereto. Furthermore, I prefer to make the length of both the sucker-rod and the drive limbs of my rocker arm variable; conveniently I accomplish this by making each limb in two sections, namely a first, inner section and a second, outer section slideable relative to the first section along the length of the rocker arm, and I provide locking means for releasably locking the second section in a fixed position relative to the first section. I also prefer to provide my rocker arm with mounting means whereby it may be mounted on the support member at a plurality of differing positions. Particularly preferred methods of accomplishing these adjustments are described hereinafter.

I also prefer to make the position at which the drive support member is mounted on the rocker arm variable. To accomplish this, I prefer to form the upper portion of the drive support member in the form of a split collar surrounding the rocker arm, this collar being provided with clamping means moveable between a clamped position, wherein the drive support member is fixedly secured to the rocker arm, and an unclamped position, wherein the drive support member can be moved along the rocker arm, thereby varying the position at which the drive support member is mounted on the rocker arm. Also, preferably the lower end of the drive support member is bifurcated into two separate limbs and the driven member is disposed between the limbs of the drive support member.

For reasons explained below, the length of the drive support member affects the acceleration imposed upon the rocker arm during the first phase of the upstroke. In order to achieve a substantial reduction in this acceleration, as compared with a sucker rod undergoing simple harmonic motion, it is preferred that when the support member of the instant pump jack is resting upon a flat surface and the rocker arm lies parallel to that surface, the length of the drive support member from the rocker arm to the axis of the pivot by which the drive support member is connected to the driven member be at least 40% of the distance from the flat surface to the rocker arm. As explained below, it may at least in some instances be advantageous to have the rocker arm somewhat longer.

A preferred pump jack of the invention will now be described in more detail, though by way of illustration only, with reference to the accompanying drawings.

DETAILED DESCRIPTION OF THE DRAWINGS

Figure 1:
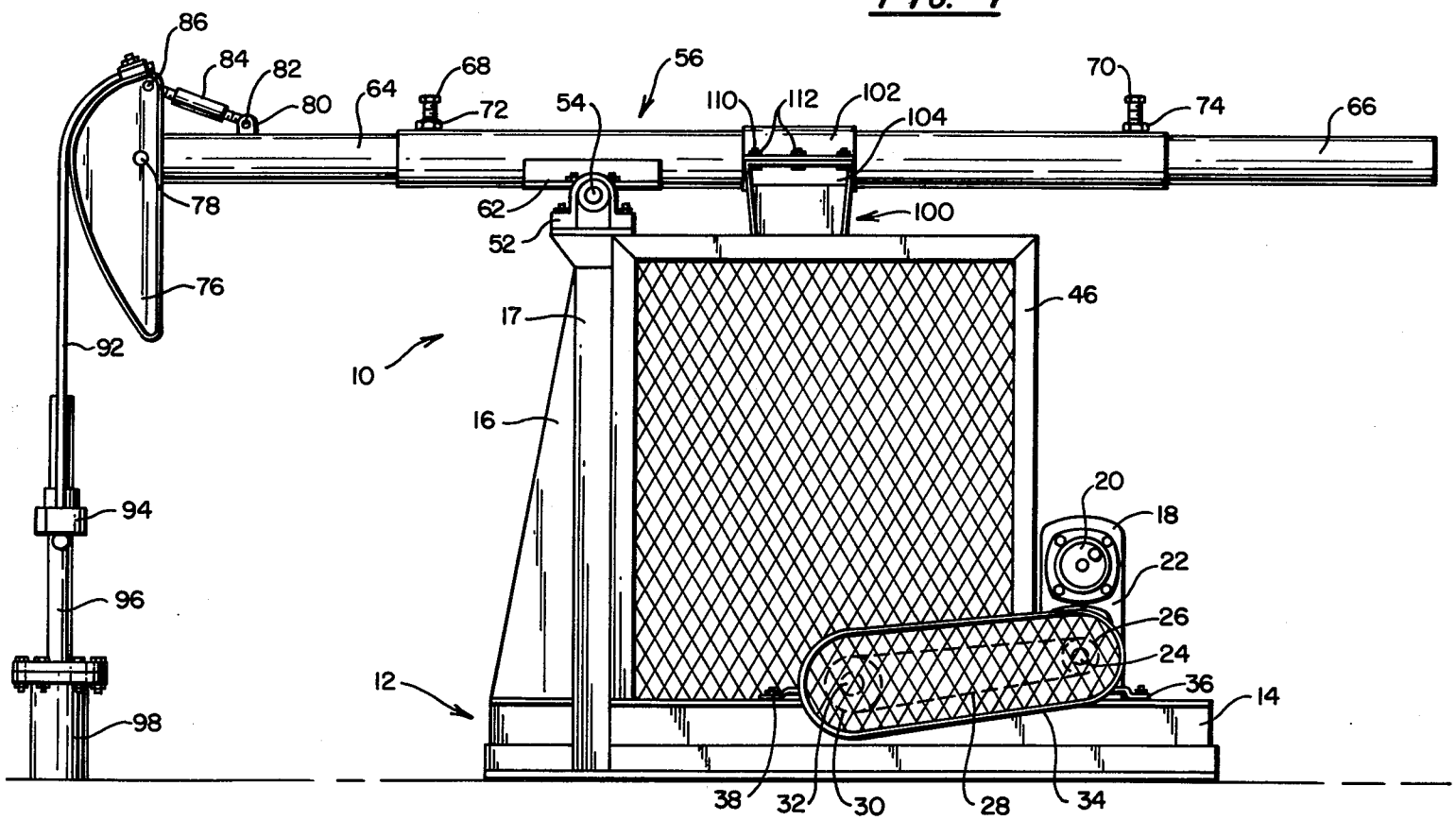
FIG. 1 is a side elevation of a pump jack of the invention.
Figure 5:
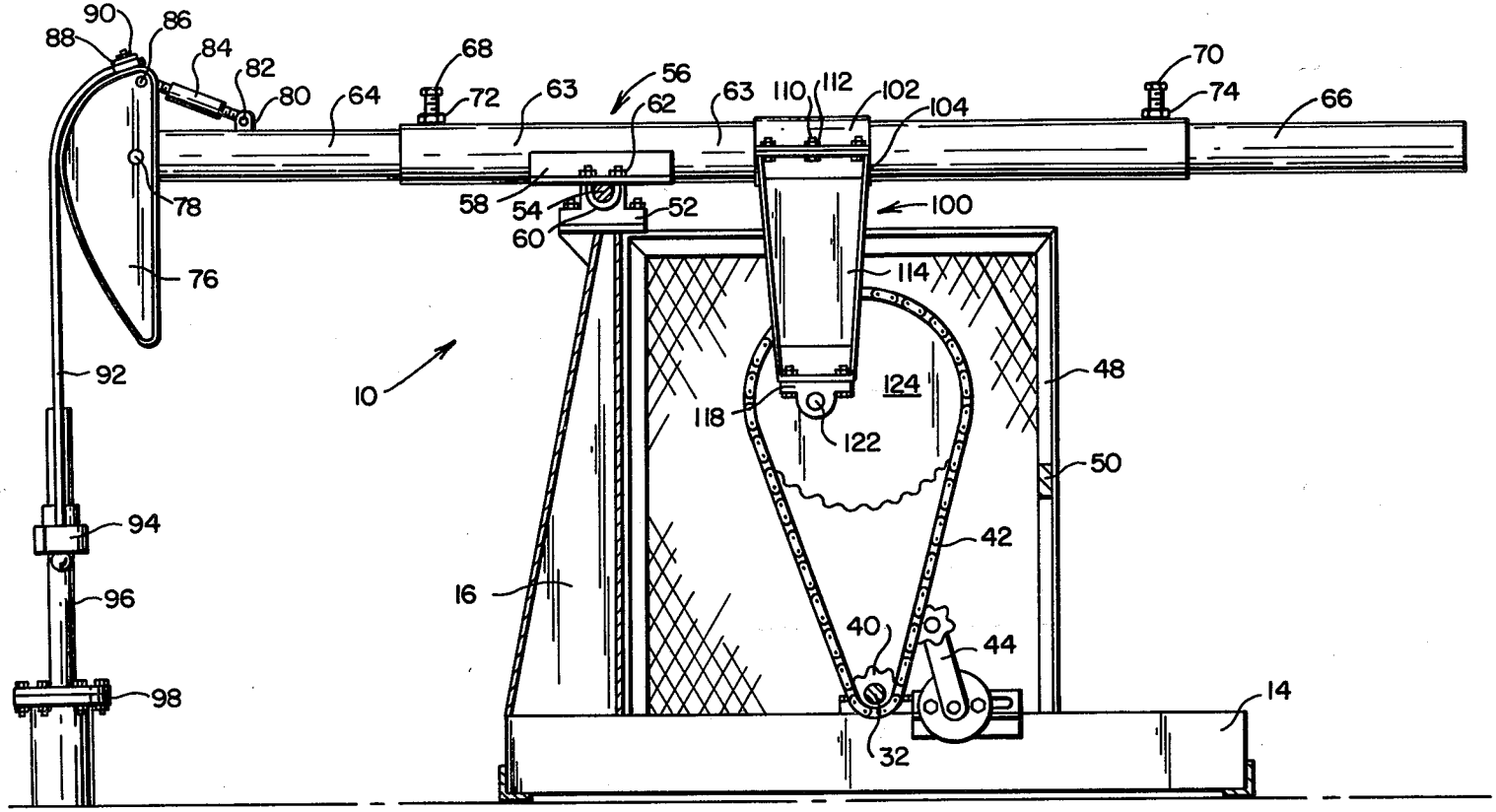
Figure 6:
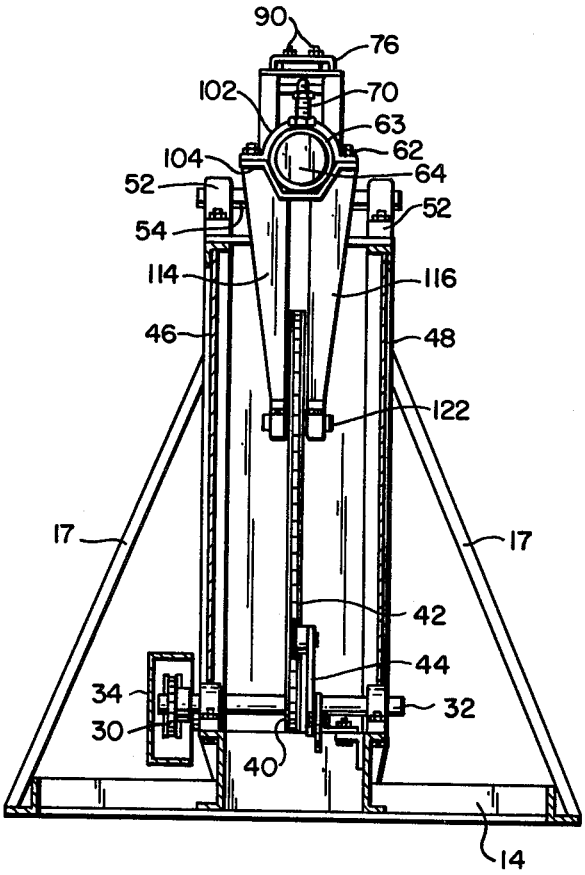

The construction of the pump jack shown in FIGS. 1–7 is best appreciated from FIGS. 1 and 5 taken together. As shown in these two figures, the pump jack (generally designated 10) comprises a support structure or member (generally designated 12), which is in two main sections namely a horizontal chassis member 14 and a vertical samson post 16 braced by two inclined struts 17 (best seen in FIGS. 3 and 4). Mounted upon the chassis member 14 is a drive unit comprising a variable-speed electric motor 18 equipped with a speed control 20. The output from the electric motor 18 passes through a gearbox 22 to a drive shaft 24 (shown in broken lines in FIG. 1). A first sprocket 26 is fixedly mounted upon the shaft 24 for rotation therewith and engages an auxiliary drive chain 28. The drive chain 28 also engages a driven sprocket 30 fixedly mounted upon a drive shaft 32. To ensure that an operator does not become entangled in the drive chain 28, the sprockets 24 and 30 and the drive chain 28 are enclosed within a housing 34 having its front face formed of a metal mesh to allow observation of the sprockets 24 and 30 and of the drive claim 28, but having solid metal sides (see FIGS. 3 and 4). The housing is bolted to the chassis member 14 via brackets 36 and 38.

The drive shaft 32 is journaled in pillar blocks (not shown) bolted to the upper face of the chassis member 14. Besides the sprocket 30, the drive shaft 32 also has fixedly mounted thereon a circular driving member in the form of a driving pinion 40 (see FIG. 5). The driving pinion 40 engages a flexible belt member in the form of a drive chain 42. A chain tensioner 44 mounted on the upper face of the chassis member 14 assists in keeping the chain 42 under tension. To avoid an operator becoming entangled in the chain 42, front and rear metal mesh screens 46 and 48 (see FIGS. 1 and 5 respectively) are provided to screen the chain 42, these screens 46 and 48 both being attached to the chassis member 14 and to the sampson post 16 and kept apart by means of a connecting member 50 (see FIG. 5).

Figure 2:
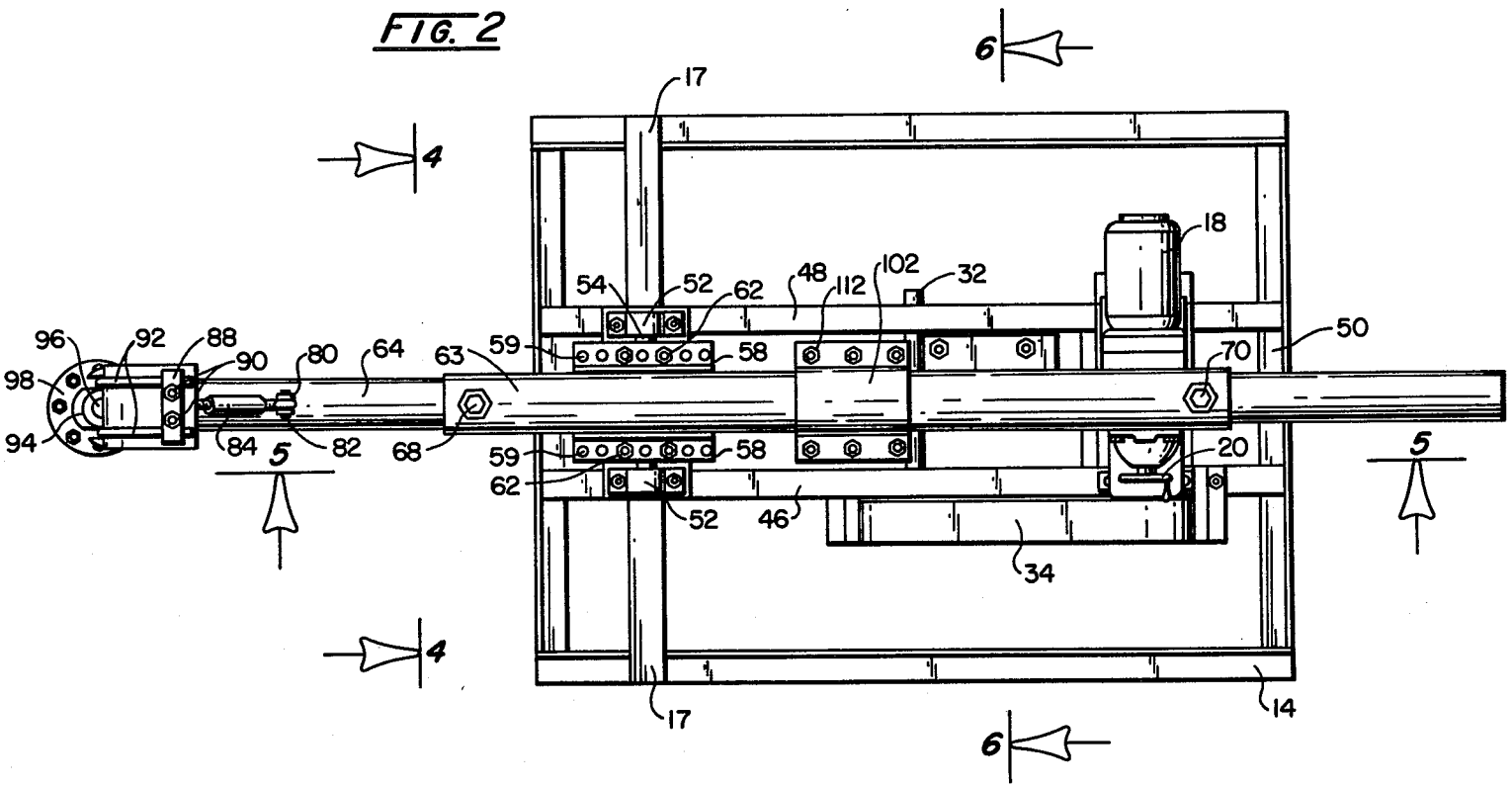
FIG. 2 is a top plan view of the pump jack shown in FIG. 1.
Figure 4:
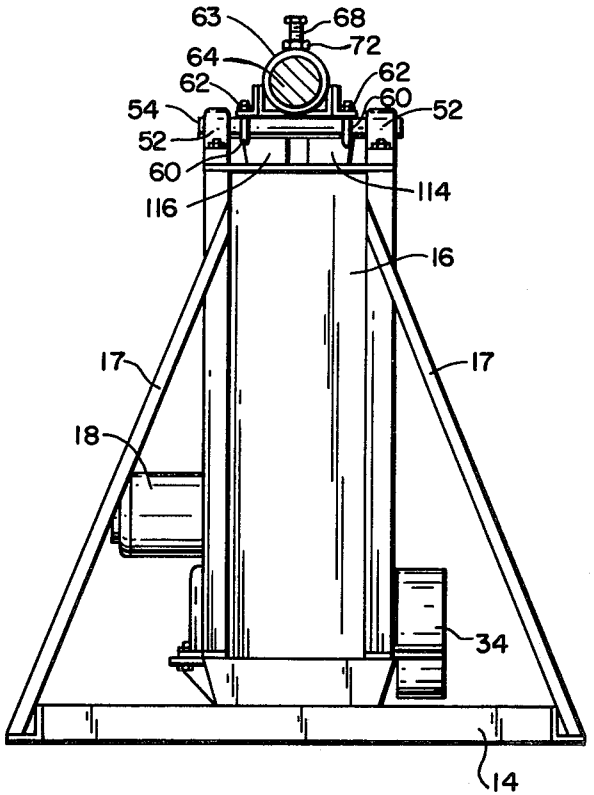
FIGS. 4, 5 and 6 are sections along the lines 4—4, 5—5 and 6—6 respectively in FIG. 2.
Figure 3:
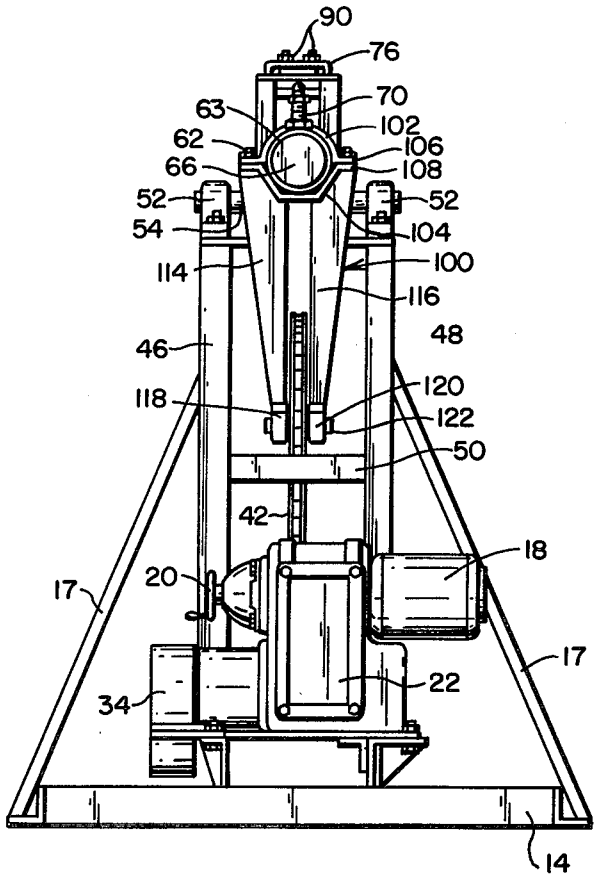
FIG. 3 is an end elevation of the pump jack shown in FIG. 1 looking from the right-hand side of that figure.

A pair of pillow blocks 52 are bolted to the upper end of the sampson post 16 and a shaft 54 is journaled in both these pillow blocks 52. The shaft 54 pivotally mounts a rocker arm 56 on the sampson post 16; as best seen in FIGS. 2 and 5, the rocker arm 56 has a pair horizontal flanges 58 extending outwardly therefrom and these flanges 58 are each provided with a plurality of mounting apertures 59 extending therethrough. Each flange 58 has a U-shaped bolt 60 associated therewith, the threaded ends of the bolt 60 passing through two of the apertures 59 and being held in position by means of nuts 62, thus clamping the rocker arm 56 to the shaft 54. The provision of a plurality of apertures 59 in each of the flanges 58 enables the rocker arm 56 to be mounted on the shaft 54 at a plurality of differing positions; it will be seen that by unscrewing the nuts 62, withdrawing the ends of the bolts 60 from the apertures 59, sliding the flanges 58 across the shaft 54, reinserting the ends of the bolts 60 into different apertures 59 and retightening the nuts 62, the position at which the rocker arm is mounted on the shaft 54 (and thus on the support member 12) may be varied.

The shaft 54 divides the rocker arm 56 into a sucker-rod limb (to the left in FIGS. 1, 2 and 5) and a drive limb (to the right in FIGS. 1, 2 and 5). The lengths of both the sucker-rod and the drive limbs of the rocker arm are variable. To provide for this variation in limb-length, the rocker arm 56 is formed in three sections. The central section 63 of the rocker arm 56, forming the inner section of both limbs of the rocker arm and bearing the flanges 58, has the form of a hollow cylinder. The outer sections of the sucker-rod and drive limbs, designated 64 and 66 respectively, are cylindrical and slideable within the hollow interior of the central section 63. It will be seen that by sliding these sections 64 and 66 into and out of the central section 63, the lengths of both the sucker-rod and drive limbs of the rocker arm 56 can be varied. To enable of the length of the two limbs to be fixed at any desired value, locking means in the form of threaded bolts 68 and 70 are provided adjacent either end of the central section 63. The locking bolts 68 and 70 are engaged in threaded bores (not shown) passing through the wall of the central section 63. To secure the sections 64 and 66 relative to the central section 63, the bolts 68 and 70 respectively are screwed inwardly until they contact the cylindrical surfaces of the sections 64 and 66 respectively, thereby preventing movement of these sections relative to the central section 63. Lock nuts 72 and 74 respectively are provided for locking the bolts 68 and 70 respectively in position. Obviously, to change the length of the sucker rod and drive limbs of the rocker arm, it is only necessary to unscrew the locking bolts 72 and 74, unscrew the bolts and 68 and 70 from contact with the sections 64 and 66 respectively, slide the sections 64 and 66 to the desired new positions, re-engage the bolts 68 and 70 with the sections 64 and 66 and retighten the lock nuts 72 and 74 respectively.

A horsehead 76 is pivotally mounted on the section 64 adjacent the outer end thereof by means of a pivot 78. To control the angle between the horsehead 76 and the section 64, the upper side of the section 64 is provided with a pair of upstanding flanges 80 (best seen in FIG. 2). A pivot 82 is journalled in bores formed in the flanges 80 and also through a bore in the lower end of a set screw 84 which is disposed between the flanges 80. The upper end of the set screw 84 is held in position by a pivot 86 which passes through bores formed in the horsehead 80 and through a corresponding bore formed in the upper end of the set screw 84. It will be seen that by varying the length of the set screw 84, the horsehead 76 can be rotated about the pivot 78 relative to the sections 64, although of course the set screw 84 serves to keep the inclination of the horsehead 76 to the section 64 constant while the pump is in operation.

A plate 88 (FIG. 2) is mounted on the upper part of the horsehead 76 by means of two bolts 90 which engage corresponding bores in the horsehead 76. The plate 88 serves to clamp to the horsehead two cables 92 which extend downwardly from the horse head to a conventional sucker-rod clamp 94. The clamp 94 is attached in the conventional manner to the upper end of a sucker rod 96 which emerges from and is slideable within a conventional well cap 98.

The adjustment in the length of the sucker-rod limb of the horsehead is provided by the sliding of the section 64 within the central section 63, and the pivoting of the horsehead 76 relative to the section 64 is controlled by the set screw 84, and together they facilitate the installation of the pump jack on a well. Because the length of the sucker-rod limb is adjustable, it is not necessary to place the pump jack in any precise position relative to the well; thus, to install the pump jack on a well, the chassis member 14 is placed on either the ground or a suitable horizontal support with the axis of the rocker arm 56 passing directly over the well. The section 64 is then slid into or out of the section 63 until the outer edge of the horsehead 76 is disposed precisely above the sucker rod 96 and then the section 64 is locked in position relative to the section 63 by means of the bolt 68 and the lock nut 72. The set screw 84 is then adjusted until the horsehead 76 is at the correct angle of inclination to the rocker arm, and the cables 92 are attached to the sucker rod clamp 94.

The adjustment of the length of the drive limb of the rocker arm provided by the sliding of the section 66 relative to the section 63 provides an elegant adjustment of the counterweight on the rocker arm and eliminates the need to lift heavy counterweights on or off the rocker arm, which is necessary to adjust the counterweighting in conventional pump jacks. It will be seen that when the section 66 is slid out of the section 63, the moment exerted by the section 66 on the rocker arm pivot 54 increases, thus achieving the same result as adding couterweights to the drive limb of a conventional pump jack. Thus, once the pump jack has been installed on the well in the manner described above, to adjust the counterweighting of the rocker arm it is only necessary to slide the section 66 into or out of the section 63 until the desired counterweighting has been achieved and then to lock the section 66 in position by means of the bolt 70 and the lock nut 74. Not only is this adjustment of the rocker arm counterweighting more convenient than lifting heavy counterweights on or off the rocker arm of a conventional pump jack, but it provides an infinitely adjustable form of counterweighting in contrast to the discontinuous adjustment of counterweighting in prior art pumps.

A drive support member (generally designated 100) extends downwardly from the drive limb of the rocker arm 56 at right angles to the axis thereof. The upper portion of the drive support member 100 is in the form of a split collar surrounding the central section 63 of the rocker arm 56, this split collar being formed by an upper semicylindrical section 102 (best seen in FIG. 3) and a lower channel section 104. Both the sections 102 and 104 are provided with pairs of horizontally extending flanges 106 and 108 respectively. Aligned bores (not shown) pass through the flanges 106 and 108 and three pairs of bolts 110 pass upwardly through these bores and are held in position by nuts 112. By loosening the nuts 112, sliding the collar along the section 63 of the rocker arm 56 and retightening the bolts 112, the position of the drive support member relative to the rocker arm 56 can be adjusted; as described in more detail below, this alters the motion of the sucker rod.

Below the channel section 108, the drive support member 100 is bifurcated into two downwardly-extending members 114 and 116. Pillow blocks 118 and 120 are bolted to the lower ends of the members 114 and 116 respectively and a shaft 122 is journaled in both pillow blocks 118 and 120. A circular driven member in the form of a driven pinion 124 is eccentrically mounted on the shaft 122 and lies between the members 114 and 116. The driven 124 engages the chain 42 so that as the chain is moved by rotation of the driving pinion 40 the driven pinion 124 rotates about the shaft 122 and, because the driven pinion 124 is eccentrically mounted on the shaft 122, the shaft 122 and the drive support member 100 oscillate through an arc of a circle centered on the axis of the shaft 54, thereby causing the rocker arm 56 to oscillate about the shaft 54.

As shown in more detail below, the motion of the sucker rod 96 varies with the length of the drive support member 100. Accordingly, if desired the drive support member could be made telescopic so that its length could be adjusted to vary the motion of the sucker rod 96. It is preferred that the length of the drive support member 100 (i.e. the distance between the axis of the rocker arm 56 and the axis of the shaft 122) be at least 40% of the distance from a flat surface to the axis of the rocker arm when the support member 12 is resting upon the flat surface and the rocker arm lies parallel to the flat surface, as shown in FIGS. 1 and 5.

Figure 7:
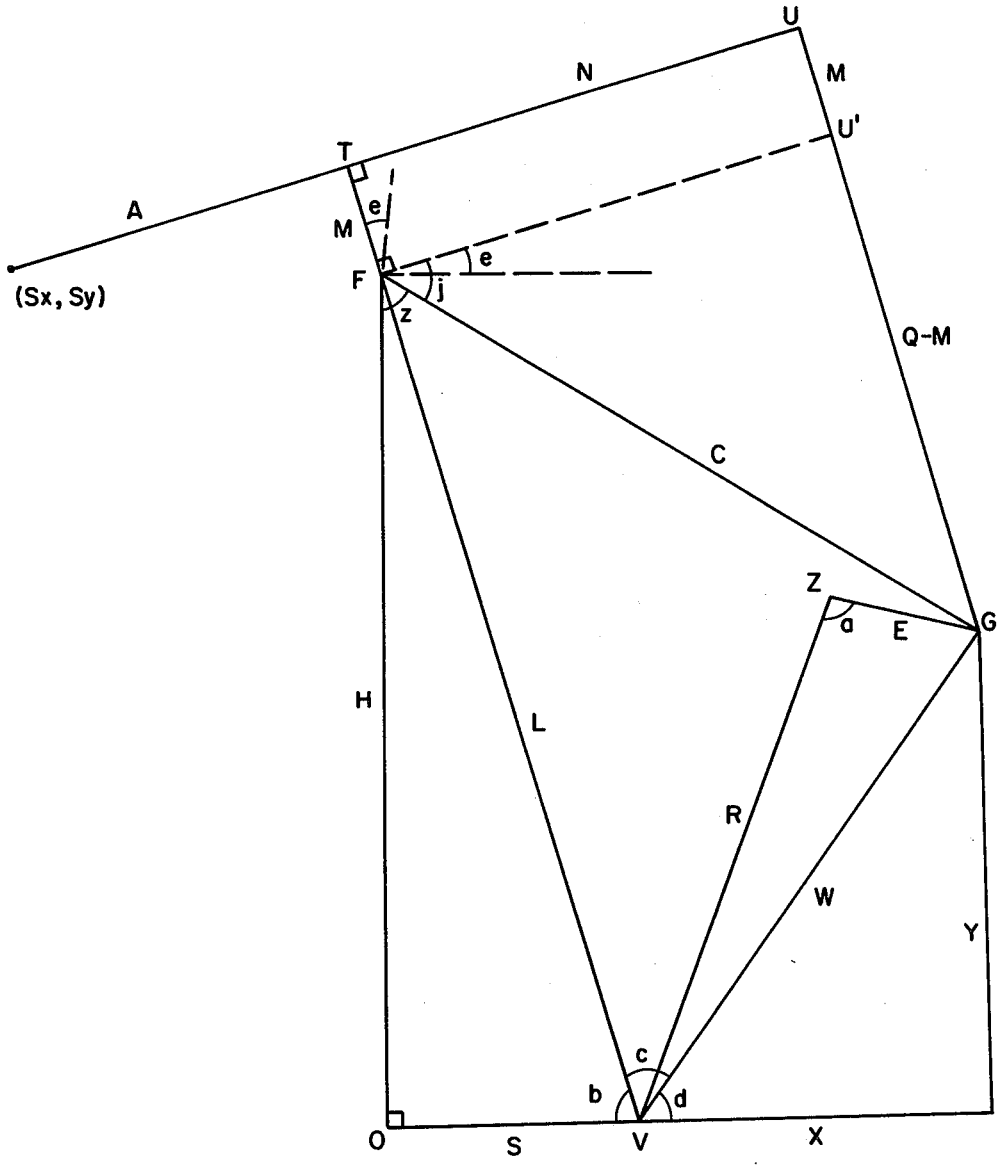
FIG. 7 is a schematic diagram showing the pump jack in the same view as FIG. 1, and indicating the various parameters used in calculating the motion of the sucker rod.

The motion of the sucker rod 96 of the pump jack shown in FIG. 1–6 is rather complex and is dependent on several parameters of the pump jack. The motion is most easily analyzed using the system of parameters shown in FIG. 7. In FIG. 7, the line TU is the axis of the rocker arm 56 and the point $(S_x, S_y)$ is the point at which this axis intersects the outer curved surface of the horsehead 76 (although, because of the curvature of the outer surface of the horsehead the point $(S_x, S_y)$ is not precisely that at which the cables 92 meet the surface of the horsehead, the resulting error is very small and is substantially the same in all the types of pump jack considered hereinafter, so that this small error is ignored in calculating the sucker rod motion). Also in FIG. 7, F is the axis of the rocker arm pivot 54, V is the axis of the drive shaft 32, G is the axis of the shaft 122 and Z is the geometric center of the driven pinion 124. The origin of coordinates O is taken where a horizontal plane through the axis V of the drive shaft 32 intersects a vertical plane through the axis F of the shaft 54. Point T is the point on the axis of the rocker arm 56 closest to the axis F of the shaft 54 while U is the point on the axis of the rocker arm 56 closest to the axis G of the shaft 122. U' is the point on the line UG at which a line through F parallel to TU intersects the line UG.

A is the length of the sucker-rod limb of the rocker arm from the point $(S_x, S_y)$ to the point T. The distance TU is designated N and the distance TF is designated M. The vertical distance from F to the origin of coordinates O is designated H and the horizontal distance from O to V is designated S. The distance FV is designated L, the distance FG is designated C, the distance VZ is designated R and the distance ZG is designated E. Finally, the distance UG is designated Q.

The aforementioned distances are all constants of the apparatus. However, for the purposes of calculating the motion of the sucker rod 96, it is also necessary to consider three variable distances, namely the distances VG (designated W) and the horizontal and vertical components of W (designated X and Y respectively).

The angle FVO, a constant, is designated b, the variable angle FVG is designated c and the variable angle between GV and the horizontal extension of OV is designated d. The variable angle VZG is designated a, while the variable angle of the sucker rod axis TU to the horizontal is designated e. Finally, the variable angle OFG is designated z, and the fixed angle GFU' is designated j.

Obviously, the constants L, b and C are given by the following equations:

$$L=(H^2+S^2)^{\frac{1}{2}} \quad (1)$$

$$b=\tan^{-1}(H/S) \quad (2)$$

$$C=(N^2+[Q-M]^2)^{\frac{1}{2}} \quad (3)$$

Applying the cosine formula to the triangle VZG in FIG. 7, one obtains:

$$W^2=R^2+E^2-2RE\cos a \quad (4)$$

Similarly, applying the cosine formula to the triangle FGV yields:

$$C^2=L^2+W^2-2LW\cos c \quad (5)$$

Rearranging equation (5) gives:

$$\cos c=(L^2+W^2-C^2)/2LW \quad (6)$$

From b and c, one can calculate d, since:

$$b+c+d=180°. \quad (7)$$

Having thus determined d and W, the distances X and Y may then be calculated from:

$$X=W\cos d \quad (8)$$

$$Y=W\sin d. \quad (9)$$

The angle z may then calculated by:

$$z=\tan^{-1}\left(\frac{S+X}{H-Y}\right)=\sin^{-1}\left(\frac{S+X}{C}\right) \quad (10)$$

Now consider the angle OFU'. Since FU' is parallel to TU and is thus at an angle of e to the horizontal, the angle OFU' must equal e+90°. However, OFU' is also equal to z+j where j is given by:

$$j=\tan^{-1}([Q-M]/N). \quad (11)$$

Accordingly:

$$e=z+j-90° \quad (12)$$

Given e, it may be seen by considering the vertical components of TF and T($S_x$, $S_y$) that:

$$S_y=H+M\cos e-A\sin e. \quad (13)$$

Thus, to calculate the vertical coordinate of the horsehead, $S_y$ from the angle a, the procedure is as follows:

(a) calculate W from equation (4);
(b) calculate c from equation (6);
(c) calculate d from equation (7);
(d) calculate X and Y from equations (8) and (9);
(e) calculate z from equation (10);
(f) calculate e from equation (12); and
(g) calculate $S_y$ from equation (13).

The calculations for the Hawley pump are exactly similar except that in this case Q is negative since the eccentric pivot of the driven sprocket is above, not below the axis of the rocker arm. Since it is reasonable to assume that the rocker arm pivot and the driven sprocket pivot will lie at approximately equal distances on opposed sides of the mid-plane of the rocker arm, in the following calculations regarding the Hawley pump Q is taken equal to −M.

Figure 8:
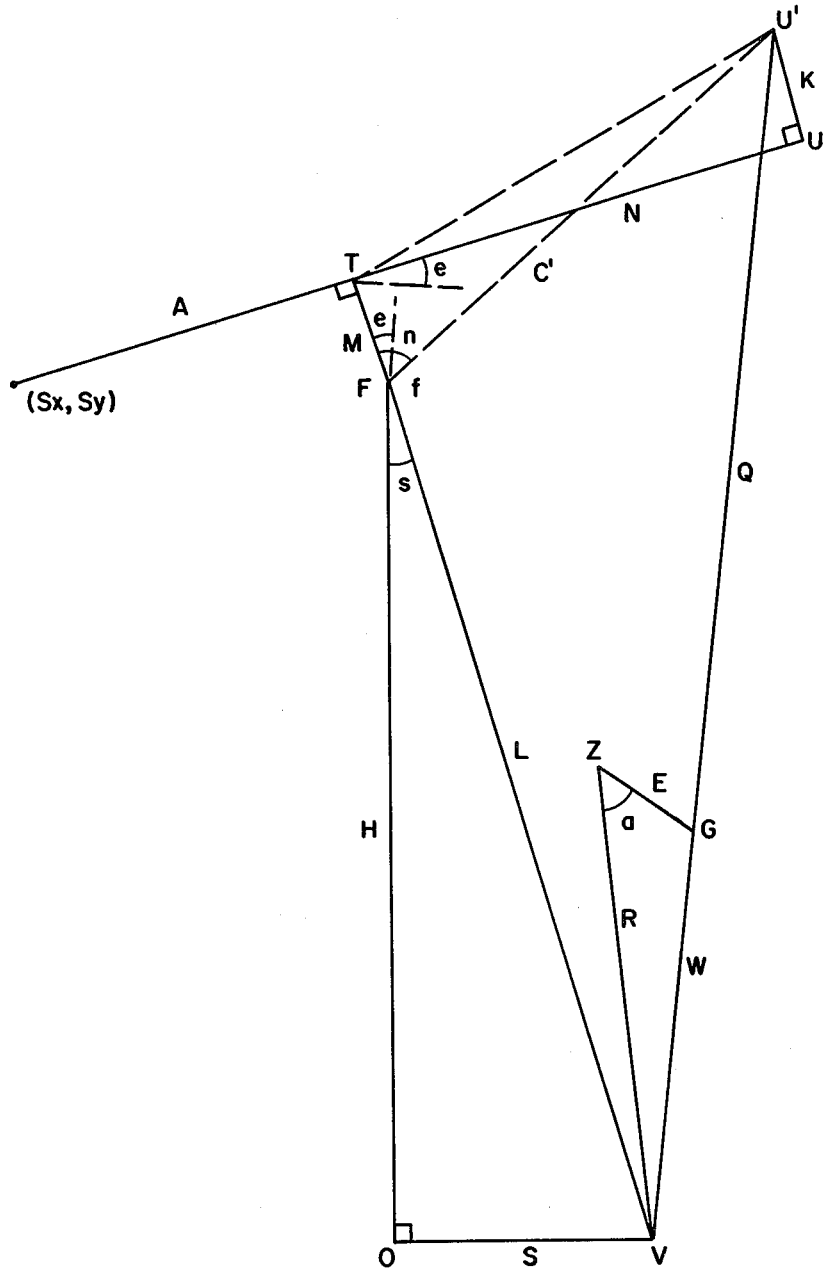
FIG. 8 is a schematic diagram similar to that of FIG. 7 but showing the parameters used to calculate the motion of Stevenson's aforementioned prior art pump.

FIG. 8 shows a schematic diagram of the Stevenson pump. In FIG. 8, $S_x$, $S_y$, A, T, N, U, M, F, e, H, O, S, V, L, Z, E, G, W, R, a and Q have the same significance as in FIG. 7 (though note that the length of the arm, Q, is now U'G, not UG). In FIG. 8, however, U' is the axis of the pivot connecting the descending arm to the rocker arm and is situated a distance k above the axis TU of the rocker arm. The angle OFV is designated s, the angle VFU' is designated f, the angle TFU' is designated n and the distance FU' which is constant, is designated C'. Obviously:

$$(C')^2=N^2+(M+k)^2 \quad (14)$$

W is again given by equation (4) above. However, because the descending arm is free to pivot about the axis U' relative to the rocker arm, the line U'GV is always straight so that:

$$VU'=W+Q \quad (15)$$

Applying the cosine formula to the triangle VFU' gives:

$$(W+Q)^2=L^2+(C')^2-2LC'\cos f \quad (16)$$

or rearranging equation (16):

$$\cos f=\frac{L^2+(C')^2-(W+Q)^2}{2LC} \quad (17)$$

By projecting the vertical line OF upwardly and considering the reflex angle OFT, it will be seen that:

$$e=s+f+n-180° \quad (18)$$

Where n and s are constants and are given by:

$$n=\tan^{-1}(N/[M+k]) \quad (19)$$

$$s=\tan^{-1}(S/H), \quad (20)$$

Once e has been calculated, $S_y$ is again given by equation (13) above. Accordingly, to determine $S_y$ from a, the procedure is as follows:

(a) calculate W from equation (4);
(b) calculate f from equation (17);
(c) calculate e from equation (18);
(d) calculate $S_y$ from equation (13).

A pump jack of the instant invention, as shown in FIGS. 1–6, was adjusted for operation on an oil well and operated with the following parameters (unless otherwise stated, hereinafter all lengths are given in inches and all angles are measured in degrees):

A=38.75
N=17.5
M=4.375
Q=21
H=44
S=24.5
R=31
E=4.5

It will be apparent that:

$$S_y(a)=S_y(360-a)$$

Since at these two values of a, G will be at the same position, Z merely being on the opposed side of the line VG. Accordingly, it is only necessary to calculate values of $S_y$ over the range of 0° to 180°, and Table 1 below shows the values of W, c, d, X, Y, z, e, and $S_y$ for the instant pump having the parameters given above at intervals of 10° in a from a=0° to a=180°.

TABLE 1

INSTANT PUMP JACK

| a | W | c | d | x | Y | z | e | $S_y$ |
|---|---|---|---|---|---|---|---|---|
| 0 | 26.500 | 5.719 | 113.391 | −10.521 | 24.322 | 35.390 | −11.079 | 55.74 |
| 10 | 26.580 | 6.477 | 112.633 | −10.229 | 24.533 | 36.245 | −10.223 | 55.18 |
| 20 | 26.816 | 8.293 | 10.816 | −9.530 | 25.065 | 38.331 | −8.138 | 53.82 |
| 30 | 27.196 | 10.517 | 108.593 | −8.671 | 25.777 | 40.978 | −5.491 | 52.06 |
| 40 | 27.704 | 12.796 | 106.314 | −7.782 | 26.589 | 43.836 | −2.632 | 50.15 |
| 50 | 28.318 | 14.965 | 104.145 | −6.920 | 27.460 | 46.745 | 0.276 | 48.18 |
| 60 | 29.013 | 16.947 | 102.163 | −6.113 | 28.362 | 49.618 | 3.150 | 46.24 |
| 70 | 29.763 | 18.706 | 100.404 | −5.375 | 29.273 | 52.403 | 5.935 | 44.35 |
| 80 | 30.542 | 20.236 | 98.876 | −4.713 | 30.176 | 55.061 | 8.592 | 42.54 |
| 90 | 31.325 | 21.536 | 97.574 | −4.129 | 31.052 | 57.559 | 11.090 | 40.84 |
| 100 | 32.089 | 22.626 | 96.483 | −3.623 | 31.884 | 59.870 | 13.401 | 39.27 |
| 110 | 32.813 | 23.525 | 95.585 | −3.193 | 32.657 | 61.971 | 15.502 | 37.86 |
| 120 | 33.478 | 24.252 | 94.858 | −2.835 | 33.358 | 63.838 | 17.369 | 36.61 |
| 130 | 34.067 | 24.828 | 94.282 | −2.544 | 33.972 | 65.453 | 18.985 | 35.53 |
| 140 | 34.568 | 25.272 | 93.838 | −2.314 | 34.491 | 66.800 | 20.331 | 34.64 |
| 150 | 34.970 | 25.598 | 93.511 | −2.142 | 34.904 | 67.862 | 21.393 | 33.94 |
| 160 | 35.262 | 25.823 | 93.287 | −2.022 | 35.204 | 68.630 | 22.161 | 33.44 |
| 170 | 35.440 | 25.954 | 93.156 | −1.951 | 35.386 | 69.093 | 22.625 | 33.13 |
| 180 | 35.500 | 25.997 | 93.113 | −1.928 | 35.448 | 69.249 | 22.780 | 33.03 |

Note that although the motion of the sucker rod, as shown by the coordinate $S_y$, is symmetrical about a=0° and a=180°, the motion is not symmetrical about a=90°, since the movement of the sucker rod around a=180° is much slower than that around a=0°. For example, a change in a from 0° to 10° produces a sucker rod displacement of 0.56 inches, whereas a corresponding change in a from 170° to 180° produces a sucker rod movement of only 0.10 inches. Since a=0° is the beginning of the downstroke of the sucker rod, whereas a=180° is the beginning of the upstroke of the sucker rod, it will be seen that the instant pump produces a very desirable type of sucker rod motion in that it produces a very small acceleration on the sucker rod at the beginning of the upstroke where, it is previously noted, the shock loading on the sucker rod is at its greatest. (Assuming that the motor drives the driving pinion 40 at a constant speed, the velocity of the drive chain 42 will be constant and thus the angular velocity of rotation of the driven pinion 124 about its geometric center will also be constant. Thus, a will change at a constant rate and the intervals of equal change in a shown in Table 1 represent equal time intervals. In this and all subsequent calculations, the effect of the chain tensioner 44 is ignored since, provided the rocker arm operates smoothly, the chain tensioner will have substantially no effect on the position of the chain, especially when the sucker rod is passing through the crucial phase of the lower part of its motion.)

The very slow, smooth motion of the sucker rod at the bottom end of its downstroke (and thus, also at the beginning of its upstroke) is further illustrated in Table 2 which shows values of $S_y$ at 1° intervals in a over the range a=170 to a=180°:

TABLE 2

INSTANT PUMP JACK

| a | $S_y$ |
|---|---|
| 170 | 53.131 |
| 171 | 33.112 |
| 172 | 33.095 |
| 173 | 33.080 |
| 174 | 33.067 |
| 175 | 33.055 |
| 176 | 33.046 |
| 177 | 33.039 |
| 178 | 33.034 |
| 179 | 33.031 |
| 180 | 33.030 |

The reduction in shock loading on the sucker rod is important not only because it reduces wear on the sucker rod and pump jack but also because it reduces the power needed to operate the pump. The jerks on the sucker rod of a conventional pump jack destroy the momentum of its moving parts and increase the energy needed to complete each pumping cycle. For example, the pump jack of the invention having the specific parameters referred to above was employed on an oil well having a depth of about 1600 ft. (488 m.) and a maximum sucker rod load on the upstroke of about 2560 lb. (1161 kg.). The pump jack was operated using as the prime mover a 110 V 60 Hz AC electric motor. The motor current was substantially constant throughout the pumping cycle and did not exceed 1.5 A. Thus, the pump jack was operating using about 0.2 HP which is much less than would be required for a conventional pump jack under the same conditions. There was no perceptible shock on the sucker rod or pump jack at the beginning of the upstroke.

The extent of the reduction in sucker rod acceleration achieved by the instant pump jack may be appreciated by comparing the values of $S_y$ give in Tables 1 and 2 with the values given in Table 3 for the displacement of a sucker rod undergoing simple harmonic motion between the same extreme positions as in Tables 1 and 2.

TABLE 3

| SIMPLE HARMONIC MOTION | |
|---|---|
| a | $S_y$ |
| 0 | 55.74 |
| 10 | 55.56 |
| 20 | 55.06 |
| 30 | 54.22 |
| 40 | 53.08 |
| 50 | 51.68 |
| 60 | 50.06 |
| 70 | 48.27 |
| 80 | 46.36 |
| 90 | 44.39 |
| 100 | 42.41 |
| 110 | 40.50 |
| 120 | 38.71 |
| 130 | 37.09 |
| 140 | 35.69 |
| 150 | 34.55 |
| 160 | 33.71 |
| 170 | 33.20 |
| 180 | 33.03 |
| 170 | 33.203 |
| 171 | 33.170 |
| 172 | 33.141 |
| 173 | 33.115 |
| 174 | 33.092 |
| 175 | 33.073 |
| 176 | 33.058 |
| 177 | 33.046 |
| 178 | 33.037 |
| 179 | 33.032 |
| 180 | 33.030 |

Comparing the latter part of Table 3 with Table 2, it will be seen that the sucker rod displacement for a change from a=170° to a=180° in the instant pump jack is only about 59% of the corresponding change for a sucker rod undergoing simple harmonic motion, and this ratio does not change substantially as the sucker rod approaches a=180° the extreme downward point of its motion. Accordingly, as compared with a pump jack which causes simple harmonic motion in the sucker rod, the instant pump jack reduces the sucker rod acceleration during the crucial period at the beginning of the upstroke by over 40%, thus greatly reducing the strain on the sucker rod and the shock loadings upon the various moving parts of the pump jack.

Also, the comparatively long stroke detailed in Table 1 should be noted. At first glance it might appear that, to a close approximation, the stroke should be given by:

$$\text{Stroke}=2EA/N$$

which is a very good approximation of a conventional oil well pump having a pivotable arm descending from the drive limb of the rocker arm and connected to a rotating arm rigidly affixed to a rotating shaft. However, for the pump for which the calculations are made in Tables 1 and 2, the above formula would predict a stroke of only 19.93 inches, whereas Table 1 shows that the stroke is actually 22.71 inches or about 14% greater. This increase in the length of stroke is due to the oscillation of the point Z in FIG. 7 through an arc of a circle centered on V as the driven pinion 124 rotates; this oscillation of the point Z through an arc of a circle causes the vertical displacement of the point G (the coordinate Y) during a pumping cycle to be considerably greater than 2E—note that in Table 1 the change Y from a=0° to a=180° is 11.12 inches, whereas 2E is only 9 inches.

Calculation shows that the acceleration imposed upon the sucker rod during the initial part of the upstroke in the instant pump jack is also substantially less than in corresponding pump jacks constructed according to the proposals in the Hawley and Stevenson patents referred to above. Tables 4 and 5 show the same data as Tables 1 and 2 for a Hawley pump jack having the same parameters as the instant pump jack to which Tables 1 and 2 relate, except that Q=−4.375 (=−M) and

R=54.059

(this value of R is taken to ensure that the value of $S_y$ for a=0 is Table 4 is substantially the same as that in Table 1).

TABLE 4

| HAWLEY PUMP JACK | | | | | | | | |
|---|---|---|---|---|---|---|---|---|
| a | W | c | d | x | Y | z | e | $S_y$ |
| 0 | 49.559 | 22.566 | 96.544 | −5.648 | 49.236 | 105.522 | −11.042 | 55.68 |
| 10 | 49.634 | 22.552 | 96.558 | −5.668 | 49.309 | 105.744 | −10.821 | 55.54 |
| 20 | 49.854 | 22.510 | 96.600 | −5.730 | 49.524 | 106.399 | −10.166 | 55.11 |
| 30 | 50.212 | 22.435 | 96.675 | −5.836 | 49.872 | 107.465 | −9.100 | 54.420 |
| 40 | 50.694 | 22.324 | 96.786 | −5.990 | 50.339 | 108.905 | −7.660 | 53.48 |
| 50 | 51.282 | 22.172 | 96.937 | −6.194 | 50.907 | 110.672 | −5.893 | 52.31 |
| 60 | 51.955 | 21.977 | 97.133 | −6.451 | 51.553 | 112.709 | −3.856 | 50.96 |
| 70 | 52.690 | 21.738 | 97.372 | −6.761 | 52.254 | 114.953 | −1.612 | 49.46 |
| 80 | 53.462 | 21.457 | 97.653 | −7.120 | 52.985 | 117.338 | 0.773 | 47.85 |
| 90 | 54.246 | 21.141 | 97.969 | −7.521 | 53.722 | 119.795 | 3.230 | 46.19 |
| 100 | 55.019 | 20.798 | 98.312 | −7.953 | 54.441 | 122.253 | 5.688 | 44.53 |
| 110 | 55.759 | 20.442 | 98.668 | −8.403 | 55.122 | 124.642 | 8.076 | 42.913 |
| 120 | 56.444 | 20.087 | 99.023 | −8.852 | 55.745 | 126.892 | 10.326 | 41.39 |
| 130 | 57.056 | 19.748 | 99.361 | −9.281 | 56.296 | 128.935 | 12.370 | 40.01 |
| 140 | 57.579 | 19.443 | 99.667 | −9.669 | 56.761 | 130.710 | 14.145 | 38.82 |
| 150 | 58.000 | 19.186 | 99.924 | −9.996 | 57.132 | 132.158 | 15.593 | 37.85 |
| 160 | 58.308 | 18.991 | 100.119 | −10.244 | 57.401 | 133.230 | 16.665 | 37.13 |
| 170 | 58.496 | 18.869 | 100.240 | −10.399 | 57.564 | 133.889 | 17.324 | 36.69 |
| 180 | 58.559 | 18.828 | 100.282 | −10.452 | 57.619 | 134.111 | 17.546 | 36.54 |

TABLE 5

| HAWLEY PUMP JACK | |
|---|---|
| a | $S_y$ |
| 170 | 36.692 |
| 171 | 36.664 |
| 172 | 36.638 |
| 173 | 36.616 |
| 174 | 36.597 |
| 175 | 36.581 |
| 176 | 36.567 |
| 177 | 36.557 |

TABLE 5-continued

| HAWLEY PUMP JACK | |
|---|---|
| a | $S_y$ |
| 178 | 36.550 |
| 179 | 36.545 |
| 180 | 36.544 |

It will be seen that the stroke of the Hawley pump is only 19.14 inches, or about 16% less than the corresponding pump jack of the instant invention. Thus, to produce the same stroke with the Hawley pump, it would be necessary to use a driven pinion having about a 19% greater eccentricity and a correspondingly greater size and weight. It is also necessary to use a much longer chain in the Hawley pump and the splitting of the rocker arm necessary to accommodate the large driven pinion seriously weakens the rocker arm.

Not only does the Hawley pump jack have a shorter stroke than the instant pump jack, but, as most clearly shown in Table 5, the Hawley pump jack forces the sucker rod to move much more quickly during the crucial initial stage of the upstroke than does the instant pump jack. In the Hawley pump, the change in $S_y$ as a changes from 170° to 180° is 0.148 inches or approximately 47% greater than the sucker rod displacement in the instant pump jack as a changes through the same interval. Accordingly, the Hawley pump will impose much greater shock loadings on the sucker rod during the initial part of its upstroke than does the instant pump jack.

Tables 6 and 7 show details of the motion of the sucker rod in a pump jack constructed according to the Stevenson patent having the same parameters as the instant pump jack previously described, except that:

k=4.375

Q=23.04

(The value of k is taken equal to −M so that the axis of the pivot attached to the rocker arm is the same as that in the Hawley pump jack just described. The value of Q is then adjusted so that the value of $S_y$ for a=0° is approximately the same as in Table 1.)

TABLE 6

| STEVENSON PUMP JACK | | | | |
|---|---|---|---|---|
| a | W | f | e | $S_y$ |
| 0 | 26.500 | 76.356 | −11.099 | 55.75 |
| 10 | 26.580 | 78.593 | −10.862 | 55.60 |
| 20 | 26.816 | 77.293 | −10.162 | 55.14 |
| 30 | 27.196 | 78.426 | −9.029 | 54.40 |
| 40 | 27.704 | 79.945 | −7.511 | 53.40 |
| 50 | 28.318 | 81.790 | −5.665 | 52.80 |
| 60 | 29.013 | 83.896 | −3.559 | 50.77 |
| 70 | 29.763 | 86.191 | −1.264 | 49.23 |
| 80 | 30.542 | 88.603 | 1.148 | 47.60 |
| 90 | 31.325 | 91.061 | 3.606 | 45.93 |
| 100 | 32.089 | 93.495 | 6.040 | 44.27 |
| 110 | 32.813 | 95.838 | 8.383 | 42.68 |
| 120 | 33.478 | 98.027 | 10.572 | 41.19 |
| 130 | 34.067 | 100.00 | 12.544 | 39.85 |
| 140 | 34.568 | 101.701 | 14.246 | 38.70 |
| 150 | 34.970 | 103.082 | 15.627 | 37.78 |
| 160 | 35.262 | 104.100 | 16.645 | 37.09 |
| 170 | 35.440 | 104.724 | 17.269 | 36.67 |
| 180 | 35.500 | 104.934 | 17.479 | 36.53 |

TABLE 7

| STEVENSON PUMP JACK | |
|---|---|
| a | $S_y$ |
| 170 | 36.675 |

TABLE 7-continued

| STEVENSON PUMP JACK | |
|---|---|
| a | $S_y$ |
| 171 | 36.648 |
| 172 | 36.624 |
| 173 | 36.603 |
| 174 | 36.585 |
| 175 | 36.569 |
| 176 | 36.557 |
| 177 | 36.547 |
| 178 | 36.540 |
| 179 | 38.536 |
| 180 | 36.534 |

Comparing Tables 6 and 7 with Tables 1 and 2, it will be seen that the stroke of the Stevenson pump jack is only 19.22 inches or approximately 85% of the stroke of the instant pump jack. Thus, as in the case of the Hawley pump jack, the Stevenson pump jack requires a larger given sprocket than the instant pump jack to achieve the same stroke.

Furthermore, comparing Table 7 with Table 2, it will be seen that the change in $S_y$ as a changes from 170° to 180° in the Stevenson pump jack is 0.141 inches, or approximately 40% greater than in the corresponding instant pump jack, despite the smaller overall stroke. Accordingly, like the Hawley pump jack, the Stevenson pump jack will impose substantially greater accelerations on the sucker rod during the initial phase of its upstroke than will the instant pump jack and will thus cause greater shock loadings on the various moving parts of the pump jack.

Table 8 below shows the affect of various varying parameters of the pump whose motion is detailed in Tables 1 and 2. In each case, one or more of the parameters Q, N, S and L are varied and the value of R is then adjusted so that the coordinate $S_y$ for a=0° is substantially the same as (or as close as physically possible to the value) in Table 1. Each of the columns A–F of Table 8 shows the value of $S_y$ at 10° intervals of a from a=0° to a=170° and at 1° from a=170° to a=180°. Thus the values of $S_y$ for the modified pump jacks whose $S_y$ values are shown Table 8 are directly comparable with the figures in Tables 1 and 2 for the original preferred instant pump jack. Except where otherwise stated, the various parameters of the pump jacks referred to in Table 8 are the same as those in Tables 1 and 2.

The parameters varied in the various columns of Table 8 are as follows:

Column A
- Q=23
- R=29.38

Column B
- Q=25
- R=27.82

Column C
- N=22.5
- Q=21
- R=28.53

Column D
- N=22.5
- Q=26
- R=24.09

Column E
- S=10
- Q=21
- N=17.5
- R=29.15

Column F
S=17.5
Q=21
N=17.5
R=29.08
Column G
S=17.5
Q=23
N=17.5
R=27.20
Column H
Q=21
L=40
R=27.4

(In this case, R is adjusted so that $S_y$—H is substantially the same as in Table 1 when a=0°.)

Comparing Column A of Table 8 with Tables 1 and 2, it will be seen that increasing Q from 21 to 23 inches, with a corresponding reduction in R from 31 to 29.38 inches increases the sucker rod stroke from 23.08 inches to 23.71 inches. However, this increase in Q actually decreases the sucker rod displacement as a changes from 170° to 180°, this displacement being 0.096 inches in Column A of Table 8 as compared with 0.101 inches in Tables 1 and 2. As will be further shown hereinafter, in general increasing Q and affecting a corresponding diminution in R decreases the proportion of the stroke length affected between a=170° and a=180°, and thus for any given sucker rod stroke decreases the acceleration imposed upon the sucker rod at the beginning of the upstroke. Furthermore, at least where S is greater than N, an increase in Q with a corresponding decrease in R increases the absolute sucker rod stroke provided (Q/H+M) does not exceed about 0.5. Accordingly, subject to appropriate constraints imposed by the requirement that the various parts of the sucker rod apparatus not interfere with each other during the pumping cycle, it is preferred that the ratio Q:H+M be greater than 0.4:1 in the instant pump.

Increasing Q further from 23 to 25 inches in passing from Column A to Column B of Table 8 actually decreases the stroke very slightly (the stroke in Column B is 23.049 inches as compared with 23.084 inches in Column A), but causes a further decrease in the sucker rod displacement as a changes from 170° to 180° (in Column B this displacement is only 0.090 inches).

Columns C and D of Table 8 show the effect of Q values of 21 and 26 inches for a N value of 22.5 inches. Comparing Column B with Tables I and II it will be seen that (not surprisingly) increasing N decreases the sucker rod stroke for a given value of Q. Comparing column D of Table 8 with Column C thereof again shows that for a constant value of N, increasing Q and affecting a corresponding decrease in R increases the sucker rod stroke while simultaneously decreasing the proportion of the stroke affected as a changes from 170° to 180°, thus producing a longer stroke with a lower accelereation on the sucker rod as the sucker rod begins the upstroke. Column E of Table 8 is provided merely to show the affect of making 5 less than N; Q in Column E is the same as in Table 1 and it will be seen that the stroke is markedly less than in Table 1, although again the change in $S_y$ as a changes from 170° to 180° is small so that the acceleration of the sucker rod during the initial phase of the upstroke is also desirably small.

Columns F and G of Table 8 show the sucker rod motions for Q equal to 21 and 23 inches respectively, with S made equal to N. In this rather peculiar situation, increasing Q from 21 to 23 inches actually affects a very minor decrease in stroke length, but does produce about a 4% decrease in the proportion of the stroke affected as a changes from 170° to 180°.

Finally, Column H of Table 8 shows that for a given value of Q decreasing L increases the stroke slightly (the stroke in Column H is 23-201 inches as compared with 23.08 in Table 1) while also slightly decreasing the sucker rod displacement as a changes from 170° to 180°.

TABLE 8

INSTANT PUMP JACK

| a | $\frac{A}{S_y}$ | $\frac{B}{S_y}$ | $\frac{C}{S_y}$ | $\frac{D}{S_y}$ | $\frac{E}{S_y}$ | $\frac{F}{S_y}$ | $\frac{G}{S_y}$ | $\frac{H}{S_y}$ |
|---|---|---|---|---|---|---|---|---|
| 0 | 5.698 | 55.218 | 55.730 | 55.743 | 55.730 | 55.725 | 55.731 | 51.567 |
| 10 | 54.812 | 53.750 | 55.509 | 55.382 | 55.553 | 55.456 | 55.420 | 50.820 |
| 20 | 53.074 | 51.801 | 54.883 | 54.454 | 55.040 | 54.696 | 54.573 | 49.196 |
| 30 | 51.133 | 49.830 | 53.932 | 53.209 | 54.230 | 53.555 | 53.340 | 47.287 |
| 40 | 49.147 | 47.878 | 52.753 | 51.816 | 53.181 | 52.155 | 51.875 | 45.294 |
| 50 | 47.176 | 45.969 | 51.430 | 50.366 | 51.955 | 50.599 | 50.285 | 43.297 |
| 60 | 45.254 | 44.125 | 50.031 | 48.912 | 50.610 | 48.965 | 48.648 | 41.339 |
| 70 | 43.409 | 42.365 | 48.609 | 47.490 | 49.202 | 47.313 | 47.016 | 39.454 |
| 80 | 41.663 | 40.705 | 47.207 | 46.126 | 47.779 | 45.691 | 45.429 | 37.665 |
| 90 | 40.034 | 39.161 | 45.857 | 44.840 | 46.381 | 44.135 | 43.92 | 35.993 |
| 100 | 38.538 | 37.747 | 44.588 | 43.650 | 45.046 | 42.676 | 42.512 | 34.457 |
| 110 | 37.190 | 36.474 | 43.422 | 42.569 | 43.802 | 41.339 | 41.229 | 33.072 |
| 120 | 36.000 | 35.354 | 42.377 | 41.611 | 42.676 | 40.143 | 40.085 | 31.849 |
| 130 | 34.980 | 34.393 | 41.469 | 40.784 | 41.690 | 39.107 | 39.096 | 30.800 |
| 140 | 34.135 | 33.598 | 40.711 | 40.096 | 40.860 | 38.242 | 38.273 | 29.931 |
| 150 | 33.473 | 32.976 | 40.111 | 39.555 | 40.201 | 37.559 | 37.624 | 29.250 |
| 160 | 32.997 | 32.528 | 39.678 | 39.165 | 39.723 | 37.066 | 37.156 | 28.760 |
| 170 | 32.710 | 32.259 | 39.416 | 38.930 | 39.434 | 36.768 | 36.874 | 28.465 |
| 171 | 32.692 | 32.242 | 39.399 | 38.915 | 39.415 | 36.749 | 36.856 | 28.446 |
| 172 | 32.676 | 32.227 | 39.384 | 38.902 | 39.399 | 36.732 | 36.840 | 28.429 |
| 173 | 32.661 | 32.213 | 39.371 | 38.890 | 39.384 | 36.717 | 36.826 | 28.415 |
| 174 | 32.649 | 32.201 | 39.359 | 38.880 | 39.372 | 36.704 | 36.813 | 28.402 |
| 175 | 32.638 | 32.191 | 39.350 | 38.871 | 39.361 | 36.693 | 36.803 | 28.391 |
| 176 | 32.630 | 32.183 | 39.342 | 38.864 | 39.352 | 36.685 | 36.794 | 28.382 |
| 177 | 32.623 | 32.177 | 39.336 | 38.858 | 39.345 | 36.678 | 36.788 | 28.375 |
| 178 | 32.618 | 32.173 | 39.331 | 38.854 | 39.341 | 36.673 | 36.783 | 28.370 |
| 179 | 32.615 | 32.170 | 39.329 | 38.852 | 39.338 | 36.670 | 36.780 | 28.367 |
| 180 | 32.614 | 32.169 | 39.328 | 38.851 | 39.337 | 36.669 | 36.779 | 28.366 |

It will be apparent to those skilled in the art that numerous changes and modifications may be made in the preferred embodiments of my invention described above. Accordingly, the foregoing description is to be construed in an illustrative and not a limitative sense, the scope of my invention being defined solely by the appended claims.

I claim:

1. A pump jack comprising:

a support structure;

a rocker arm pivotally mounted intermediate its ends on said structure, said rocker arm being divided by said pivoted mounting into a sucher-rod limb and a drive limb;

sucker rod attachment means disposed adjacent the end of said sucker-rod limb for attaching a sucker rod to said rocker arm;

a drive support member non-rotatably mounted on said rocker arm and having a lower end disposed beneath said drive limb of said rocker arm;

a circular driven member rotatably and eccentrically mounted on said drive support member;

a circular driving member mounted for rotation about its axis, said axis being fixed relative to said support structure;

drive means for rotating said driving member about its axis;

a flexible belt member engaging said driving and driven members such that said rotation of said driving member will cause the driven member to rotate about the point at which said driven member is mounted on said drive support member; and means for adjusting the length of the sucker rod limb between the pivoted mounting and the sucker rod attachment means while maintaining the length of the drive limb constant, said sucker-rod limb of said rocker arm comprises a first, inner section, a second, outer section bearing said sucker rod attachment means and slideable relative to said first section along the length of said rocker arm, and locking means for releasably locking said second section in a fixed position relative to said first section, said first section has the form of a hollow cylinder, said second section has the form of a cylinder slideable within the hollow interior of said first section and said locking means, when locked, extends through the wall of said first section and engages the cylindrical surface of said second section, thereby locking said two sections in position relative to one another.

2. A pump jack according to claim 1 wherein said driving and driven structure comprise sprockets and said flexible belt member comprises a chain.

3. A pump jack according to claim 2 wherein a chain tensioner is provided for maintaining tension in said chain.

4. A pump jack according to claim 1 wherein said sucker rod attachment means comprises a horsehead pivotally mounted on said rocker arm, and wherein horsehead adjustment means are provided for pivoting said horsehead relative to said rocker arm and holding said horsehead at varying angles relative to said rocker arm.

5. A pump jack according to claim 1 wherein said rocker arm is provided with mounting means whereby it may be mounted on said support member at a plurality of differing positions.

6. A pump jack according to claim 5 wherein a substantially horizontal pivot is disposed at the upper end of said support structure and said rocker arm carries a pair of outwardly-extending flanges on opposed sides thereof, each of said flanges defining a plurality of pairs of mounting apertures passing therethrough, and wherein a pair of substantially U-shaped clamps have their open ends secured in one of said pairs of mounting apertures so that said clamps surround said pivot, one of said pair of clamps being secured to each of said pair of flanges, whereby the position at which said rocker arm is mounted on said support structure may be varied by securing said clamps in a different one of said pairs of mounting apertures.

7. A pump jack according to claim 1 including means for adjusting the position at which said drive support member is mounted on said rocker arm.

8. A pump jack according to claim 7 wherein the upper portion of said drive support member has the form of a split collar surrounding said rocker arm, said collar being provided with clamping means moveable between a clamped position, wherein said drive support member is fixedly secured to said rocker arm, and an unclamped position, wherein said drive support member can be moved along said rocker arm, thereby varying the position at which said drive support member is mounted on said rocker arm.

9. A pump jack according to claim 1 wherein at least the lower end of said drive support member is bifurcated into two separate limbs and wherein said driven member is disposed between said limbs of said drive support member.

10. A pump jack according to claim 1 including means for adjusting the position at which said drive support member is mounted on said rocker arm.

11. A pump jack comprising:

a support structure a rocker arm pivotally mounted intermediate its ends on said support structure, said rocker arm being divided by said pivoted mounting into a sucker-rod limb and a drive limb, sucker rod attachment means disposed adjacent the end of said sucker-rod limb for attaching a sucker rod to said rocker arm;

a drive support member non-rotatably mounted on said rocker arm and having a lower end disposed beneath said drive limb of said rocker arm;

a circular driven member rotatably and eccentrically mounted on said drive support member;

a circular driving member mounted for rotation about its axis, said axis being fixed relative to said support structure;

drive means for rotating said driving member about its axis; and a flexible belt member engaging said driving and driven members such that said rotation of said driving member will cause said driven member to rotate about the point at which said driven member is mounted on said drive support member, the length of said drive support member being such that when said support structure is resting upon a flat surface and said rocker arm lies parallel to said surface, the length of said drive support member from said rocker arm to the axis of the pivot by which said drive support member is connected to said driven member is at least 40% of the distance from said flat surface to said rocker arm, said sucker-rod limb of said rocker arm comprises a first, inner section, a second, outer section bearing said sucker rod attachment means and slideable relative to said first section along the length of said rocker arm, and locking means for releasably locking said second section in a fixed position relative to said first section;

said first section has the form of a hollow cylinder, said second section has the form of a cylinder slideable within the hollow interior of said first section and said locking means, when locked, extends through the wall of said first section and engages the cylindrical surface of said second section, thereby locking said two sections in position relative to one another.

12. A pump jack according to claim 11 wherein said rocker arm is provided with mounting means whereby it may be mounted on said support structure at a plurality of differing positions.

13. The pump jack of claim 11 including means for adjusting the length of the sucker rod limb between the pivoted mounting and the sucker rod attachment while maintaining the length of the drive limb constant.

* * * * *